US012446677B2

(12) United States Patent
Tuttle

(10) Patent No.: US 12,446,677 B2
(45) **Date of Patent: *Oct. 21, 2025**

(54) HANDLE FOR NAIL POLISH APPLICATOR

(71) Applicant: Kaz Europe Sárl, Bussigny (CH)

(72) Inventor: Sarah Gibson Tuttle, Los Angeles, CA (US)

(73) Assignee: Kaz Europe Sárl, Bussigny (CH)

( * ) Notice: Subject to any disclaimer, the term of this patent is extended or adjusted under 35 U.S.C. 154(b) by 0 days.

This patent is subject to a terminal disclaimer.

(21) Appl. No.: 19/083,103

(22) Filed: Mar. 18, 2025

(65) Prior Publication Data

US 2025/0241427 A1 Jul. 31, 2025

Related U.S. Application Data

(63) Continuation of application No. 17/937,913, filed on Oct. 4, 2022, which is a continuation-in-part of application No. 29/788,902, filed on Aug. 11, 2021, now Pat. No. Des. 990,041, which is a continuation of application No. 29/767,061, filed on Jan. 20, 2021, now Pat. No. Des. 930,239, which is a continuation of (Continued)

(51) Int. Cl.
*A45D 34/04* (2006.01)

(52) U.S. Cl.
CPC ..... *A45D 34/045* (2013.01); *A45D 2200/10* (2013.01)

(58) Field of Classification Search
CPC .. A45D 34/045; A45D 34/046; A45D 34/048; A45D 29/00; A45D 29/11; A45D 29/12; A45D 29/007; A45D 2200/10; A45D 2200/25; A45D 2200/1009; A45D 2200/1063; A45D 2200/1045; A45D 2029/005

See application file for complete search history.

(56) References Cited

U.S. PATENT DOCUMENTS 2,248,011 A 7/1941 Neuschafer
2,268,740 A 1/1942 Cory (Continued)

FOREIGN PATENT DOCUMENTS

DE 202010013587 U1 1/2012
EP 1384416 1/2004

(Continued)

OTHER PUBLICATIONS

Amethyst [online], [site viited Oct. 8, 2020]. Available from internet, URL:<https://shop.miniluxe.com/prducts/ametheyst?gclid=Cj0KCQjw8fr7BRDSARIsAK0Qqr4RvkzRA_8DBtj9Kgeg1gID4aPVfFf9w56W7xlvEVMRnGg_QkV3FIMaAuQTEALw_wcB> (Year: 2020).

(Continued)

*Primary Examiner* — Rachel R Steitz
*Assistant Examiner* — Karim Asqiriba
(74) *Attorney, Agent, or Firm* — Knobbe, Martens, Olson & Bear, LLP

(57) ABSTRACT

Handles for use with a substance applicator are described. The handles can include a handle portion and a neck portion. The handle portion can include a curved top surface and a curved bottom surface. The neck portion can include an opening to receive a portion of the substance applicator such that when the portion of the substance applicator is inserted into the opening, a user can use the handle to hold the substance applicator when applying a substance to a nail of the user.

15 Claims, 14 Drawing Sheets

Related U.S. Application Data application No. 29/686,865, filed on Apr. 8, 2019, now Pat. No. Des. 911,601.

(56) References Cited

U.S. PATENT DOCUMENTS

| | | | |
|---|---|---|---|
| 3,341,884 | A | 9/1967 | Pryor |
| D216,777 | S | 3/1970 | Nelson |
| 4,627,758 | A | 12/1986 | Winthrop |
| D328,654 | S | 8/1992 | Mizobata et al. |
| 5,470,162 | A | 11/1995 | Rubin |
| 5,762,077 | A | 6/1998 | Griffiths |
| 5,887,753 | A | 3/1999 | Poolman |
| 6,004,055 | A | 12/1999 | Cheng |
| 6,062,229 | A | 5/2000 | Kandratavich et al. |
| 6,302,607 | B1 | 10/2001 | Burrowes et al. |
| 6,328,040 | B1 | 12/2001 | Stein |
| D461,596 | S | 8/2002 | Angeletta |
| D473,793 | S | 4/2003 | Paster |
| D499,207 | S | 11/2004 | Angeletta |
| D514,939 | S | 2/2006 | Miozzo et al. |
| D544,350 | S | 6/2007 | Mettler et al. |
| D547,189 | S | 7/2007 | Legros |
| D562,152 | S | 2/2008 | Beam et al. |
| D580,598 | S | 11/2008 | Yamada et al. |
| D581,280 | S | 11/2008 | Oates |
| D657,252 | S | 4/2012 | Crapser et al. |
| D680,265 | S | 4/2013 | DeMarco et al. |
| D708,065 | S | 7/2014 | Pourian |
| D735,406 | S | 7/2015 | Poletto |
| D752,987 | S | 4/2016 | Dyer et al. |
| D753,402 | S | 4/2016 | Telwar |
| 9,737,126 | B1 | 8/2017 | Fishman |
| 9,763,508 | B2 | 9/2017 | Reishus et al. |
| D803,063 | S | 11/2017 | Matuszczak |
| D812,809 | S | 3/2018 | Nicoline |
| D826,473 | S | 8/2018 | Pires et al. |
| D827,442 | S | 9/2018 | Stone et al. |
| 10,092,077 | B1 | 10/2018 | Tuttle |
| D841,234 | S | 2/2019 | Laaly |
| 10,306,969 | B1 | 6/2019 | Laaly |
| D854,242 | S | 7/2019 | Tuttle |
| 10,524,546 | B2 | 1/2020 | Votel |
| D911,601 | S | 2/2021 | Tuttle |
| D930,239 | S | 9/2021 | Tuttle |
| 2003/0034322 | A1 | 2/2003 | Doherty |
| 2003/0152411 | A1 | 8/2003 | Prokopos |
| 2004/0071493 | A1 | 4/2004 | Hendrix-Stavropoulos |
| 2005/0025557 | A1 | 2/2005 | De LaForcade |
| 2005/0249538 | A1 | 11/2005 | Patel |
| 2006/0207622 | A1 | 9/2006 | Gueret |
| 2006/0225759 | A1 | 10/2006 | Fukuda |
| 2006/0289537 | A1 | 12/2006 | Ficcadenti |
| 2007/0172305 | A1 | 7/2007 | Altonen et al. |
| 2008/0271320 | A1 | 11/2008 | Brunner |
| 2009/0214283 | A1 | 8/2009 | Thiebaut et al. |
| 2011/0243639 | A1 | 10/2011 | Francavilla |
| 2012/0048290 | A1 | 3/2012 | Cappello |
| 2014/0133895 | A1 | 5/2014 | Dockery |
| 2014/0373860 | A1 | 12/2014 | Hwang |
| 2015/0100002 | A1 | 4/2015 | Choi |
| 2015/0110542 | A1 | 4/2015 | Lee |
| 2016/0095415 | A1 | 4/2016 | Nakajima et al. |
| 2016/0143415 | A1 | 5/2016 | Laaly |
| 2016/0295986 | A1 | 10/2016 | Boyle |
| 2017/0006997 | A1 | 1/2017 | Langdon |
| 2017/0112260 | A1 | 4/2017 | Stanton |
| 2017/0303658 | A1 | 10/2017 | Becker |
| 2020/0054108 | A1 | 2/2020 | Tuttle |
| 2020/0121068 | A1 | 4/2020 | Tarabotti |

FOREIGN PATENT DOCUMENTS

| | | | |
|---|---|---|---|
| FR | 3026614 | A1 | 4/2016 |
| JP | 1647488 | | 12/2019 |
| JP | 1656509 | S | 4/2020 |
| KR | 20-0367470 | Y1 | 11/2004 |
| KR | 10-2005-0031897 | A | 4/2005 |
| KR | 301070994.0000 | | 8/2020 |
| WO | WO 01-01813 | A1 | 1/2001 |
| WO | WO 03-003873 | A1 | 1/2003 |
| WO | WO 2004-062422 | A1 | 7/2004 |
| WO | WO 2018-005504 | | 1/2018 |

OTHER PUBLICATIONS

Decision of Registration dated Feb. 18, 2020 in Japanese Patent Application No. 2019-022246; 9 pages.

Germany Official Design Gazette vol. No. 21 dated Nov. 10, 2000; 5 pages.

Notice of Allowance dated Oct. 18, 2019 in Japanese Patent Application No. 2019-007452; 5 pages.

PCT Written Opinion and Search Report dated Aug. 2, 2018 regarding International Application No. PCT/US2018/026818 (12 pages).

The Poppy, announced 2019 [online], [site visited Oct. 8, 2020]. Available from internet, URL:,https://oliveandjune.com/products/the-poppy> (Year: 2019).

HANDLE FOR NAIL POLISH APPLICATOR

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application is a continuation of U.S. patent application Ser. No. 17/937,913, entitled "HANDLE FOR NAIL POLISH APPLICATOR," filed Oct. 4, 2022, which is a continuation-in-part of U.S. Design patent application Ser. No. 29/788,902, entitled "HANDLE FOR NAIL POLISH APPLICATOR," filed Aug. 11, 2021, now U.S. Design Patent D990,041, which is a continuation of U.S. Design patent application Ser. No. 29/767,061 entitled "HANDLE FOR NAIL POLISH APPLICATOR," filed Jan. 20, 2021, now U.S. Design Patent D930,239, which is a continuation of U.S. Design patent application Ser. No. 29/686,865 entitled "HANDLE FOR NAIL POLISH APPLICATOR," filed Apr. 8, 2019, now U.S. Design Patent D911,601, each of which is hereby incorporated by reference herein.

BACKGROUND

Field

The present application relates to handles for nail polish applicators, more specifically handles with a curved top surface, a curved bottom surface and an opening configured to receive a portion of a nail polish applicator.

Description

Nail polish applicators are usually provided within the bottle containing the nail polish (e.g., attached to a stem that extends from the underside of the cap of the bottle). However, the cap of the bottle is typically small such that it can be difficult to comfortably hold the cap when applying nail polish to a nail. In addition, the cap of the bottle is typically round making it difficult for a user to hold the cap without the applicator rotating and keep a broad side of the applicator facing the nail.

SUMMARY

Accordingly, there is a need for a handle that can couple to the cap of a nail polish applicator for a user to hold when applying nail polish, nail art, etc. to or removing them from anils. Disclosed herein are embodiments of a handle that can be coupled to the cap of a nail polish applicator and methods of use. Advantageously, the handle overcomes at least some of the drawbacks of existing applicators discussed above.

For purposes of this summary, certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

In some embodiments, a handle for a nail polish applicator can include: a body including: a handle portion including a top surface and a bottom surface, at least a portion of the top surface and at least a portion of the bottom surface both being curved; and a neck portion attached to the handle portion and including an end surface having an opening configured to receive a nail polish applicator, wherein the top surface and the bottom surface both have a rounded outer profile when viewed in plan view.

In some embodiments, the handle portion can have a maximum width that is greater than a maximum width of the neck portion.

In some embodiments, the maximum width of the handle portion can be about twice the maximum width of the neck portion.

In some embodiments, at least a portion of the top surface can be concave.

In some embodiments, at least a portion of the bottom surface can be convex.

In some embodiments, the end surface can be perpendicular to at least a portion of the top surface and to at least a portion of the bottom surface.

In some embodiments, a maximum height of the end surface can be smaller than a maximum height of the handle portion between the top surface and the bottom surface.

In some embodiments, the opening can extend from the end surface into the handle portion.

In some embodiments, the opening can include a rounded profile.

In some embodiments, the opening can include one or more slots around an outer edge of the opening.

In some embodiments, the opening can include four slots.

In some embodiments, the opening can include two large slots and two small slots, wherein the two large slots are distributed opposite each other, and the two small slots are distributed opposite each other.

In some embodiments, a handle for a nail polish applicator can consist of: a single piece body having: a handle portion having a top surface including a concave surface, and a bottom surface including a curved surface; and a neck portion extending from the handle portion to an end surface, the end surface having an opening configured to receive the nail polish applicator; wherein the handle portion is wider in plan view than the neck portion, wherein the handle portion has a rounded outer profile in plan view.

In some embodiments, the curved surface of the bottom surface can be convex.

In some embodiments, the end surface can be perpendicular to at least a portion of the top surface and to at least a portion of the bottom surface.

In some embodiments, a maximum height of the end surface can be smaller than a maximum height of the handle portion between the top surface and the bottom surface.

In some embodiments, the opening can extend from the end surface into the handle portion.

In some embodiments, the opening can include a rounded profile.

In some embodiments, the opening can include one or more slots around an outer edge of the opening.

In some embodiments, the opening can include four slots.

All of these embodiments are intended to be within the scope of the invention herein disclosed. These and other embodiments will become readily apparent to those skilled in the art from the following detailed description having reference to the attached figures, the invention not being limited to any particular disclosed embodiment(s).

BRIEF DESCRIPTION OF THE DRAWINGS

These and other features, aspects, and advantages of the present application are described with reference to drawings of certain embodiments, which are intended to illustrate, but not limit the present disclosure. It is to be understood that the attached drawings are for the purpose of illustrating concepts disclosed in the present application and may not be to scale.

DETAILED DESCRIPTION

Figure 1:
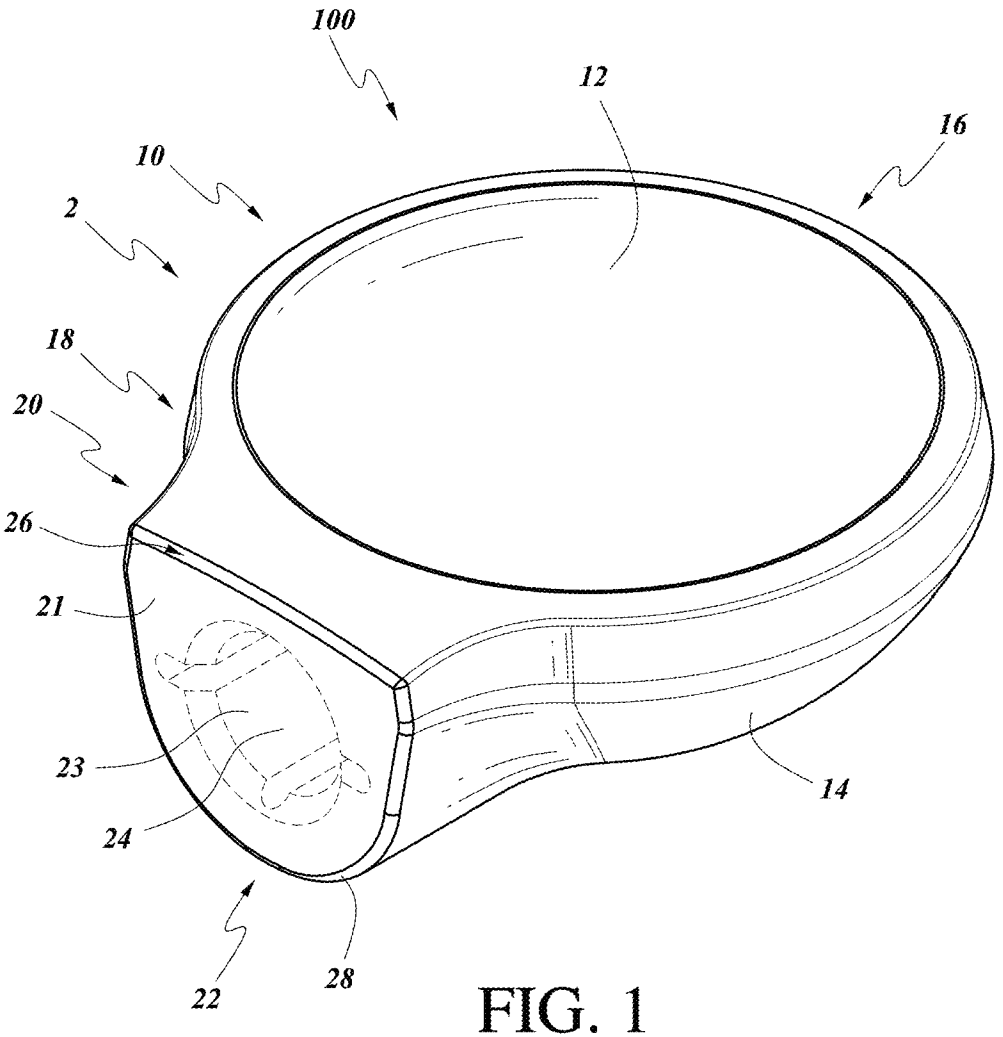
FIG. 1 is a perspective top view of a handle in accordance with aspects of this disclosure.
Figure 2:
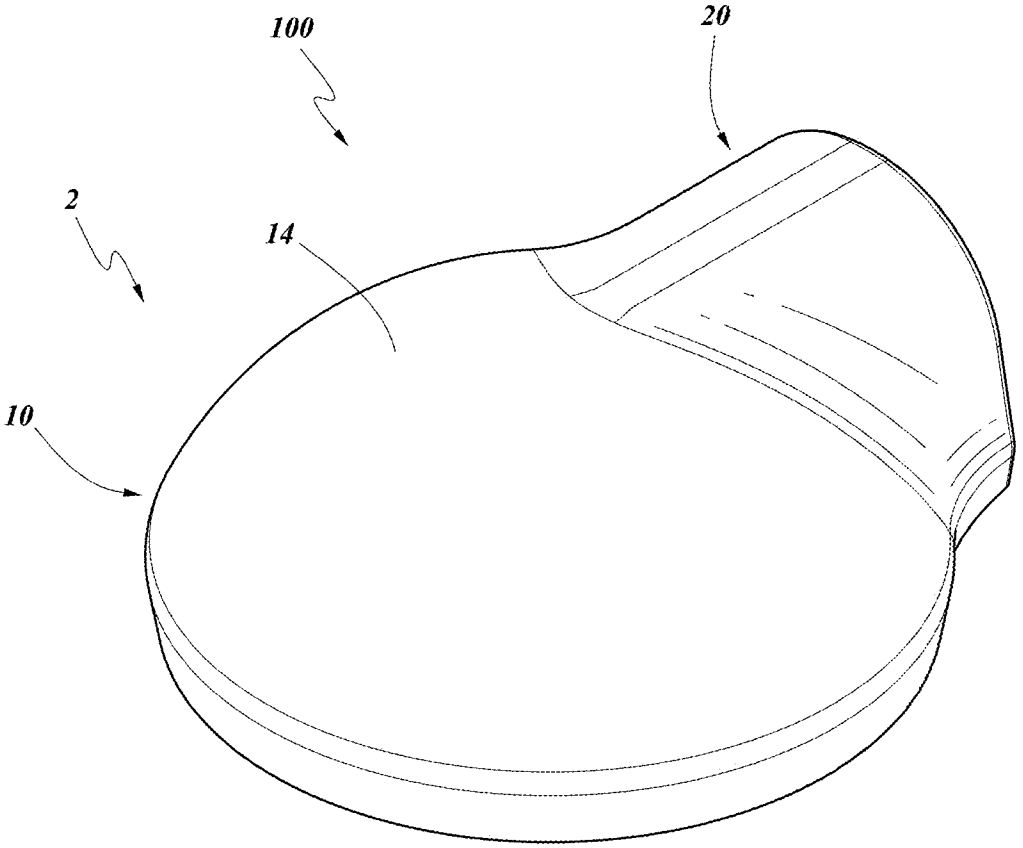
FIG. 2 is a perspective bottom view of a handle in accordance with aspects of this disclosure.

Although several embodiments, examples and illustrations are disclosed below, it will be understood by those of ordinary skill in the art that inventions described herein extend beyond the specifically disclosed embodiments, examples, and illustrations and includes other uses of the inventions and obvious modifications and equivalents thereof. Embodiments of the inventions are described with reference to the accompanying figures, wherein like numerals refer to the like elements throughout. The terminology used in the description presented herein is not intended to be interpreted in any limited or restrictive manner simply because it is being used in conjunction with a detailed description of certain specific embodiments of the inventions. In addition, embodiments of the inventions can include several novel features and no single feature is solely responsible for its desirable attributes or is essential to practicing the inventions herein described.

Disclosed herein are embodiments of a handle for a substance applicator (e.g., nail polish, nail art, nail polish remover). The handle can be handheld. The handle can have shapes other than the shapes described below. The handle can be made of any suitable material (e.g., plastic, metal, silicone etc.) The handle can be made via using a suitable process, such as molding (e.g., injection molding), casting, 3D printing or additive manufacturing, etc.

FIGS. 1-8 show a handle 100 for an applicator for applying a substance (e.g., nail polish, nail art, nail polish remover) to a nail (finger or toe nail) of a user's finger(s) and/or toes(s). The handle 100 can include a body 2 including a handle portion 10 and a neck portion 20. The body 2 can extend between a proximal end 16 and a distal end 22. The handle portion 10 can extend between the proximal end 16 and a distal end 18 of the handle portion 10, and the neck portion 20 can extend from the distal end 18 of the handle portion 10 to the distal end 22. In some embodiments, the body 2 can be a single piece (e.g., monolithic, seamless piece). Alternatively, the neck portion 20 can removably couple to the distal end 18 of the handle portion 10.

Figure 4:
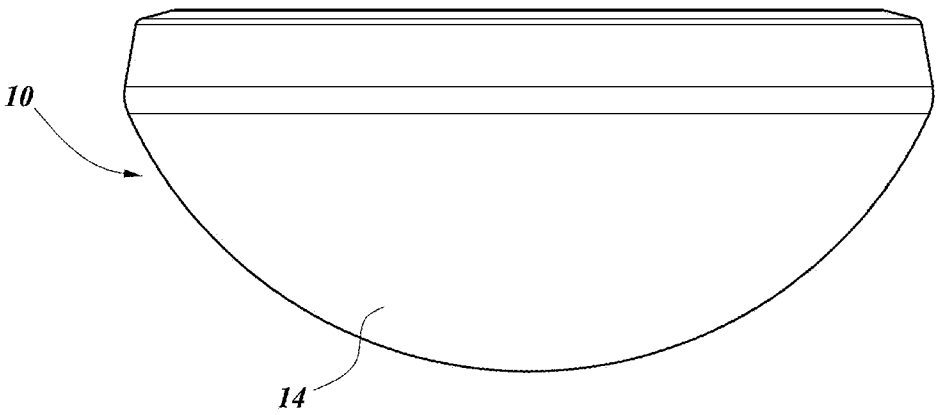
FIG. 4 is a rear view of a handle in accordance with aspects of this disclosure.
Figure 5:
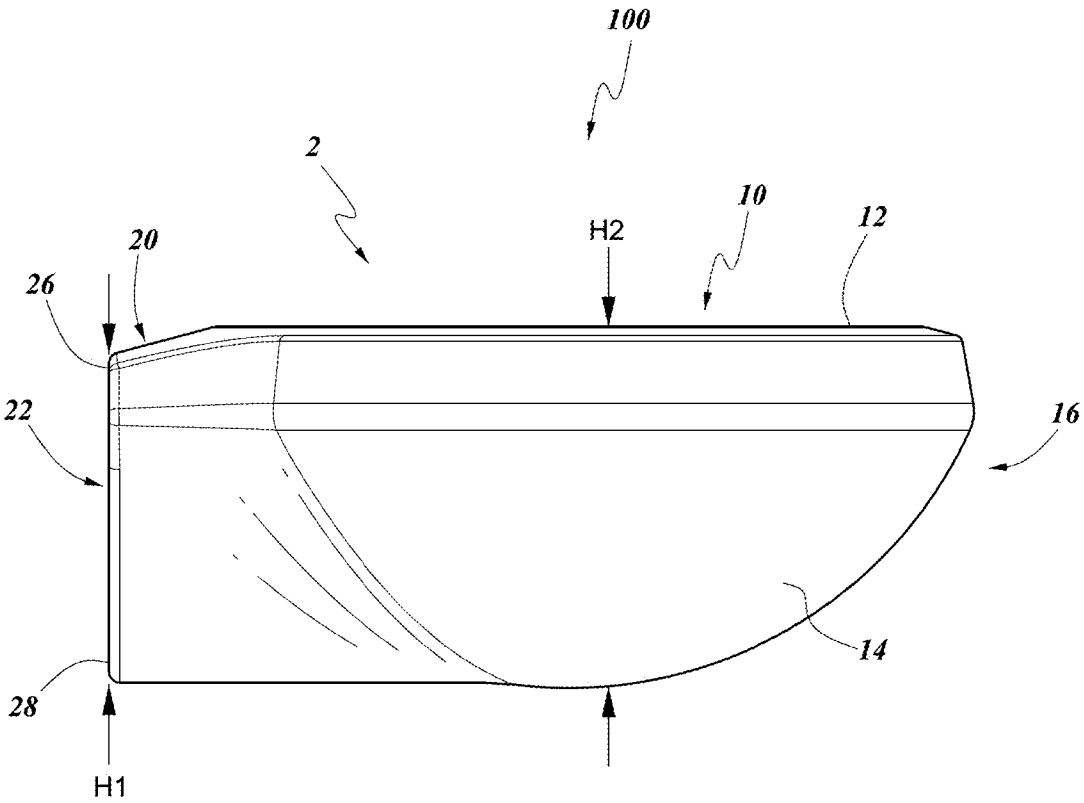
FIG. 5 is a right-side view of a handle in accordance with aspects of this disclosure.
Figure 6:
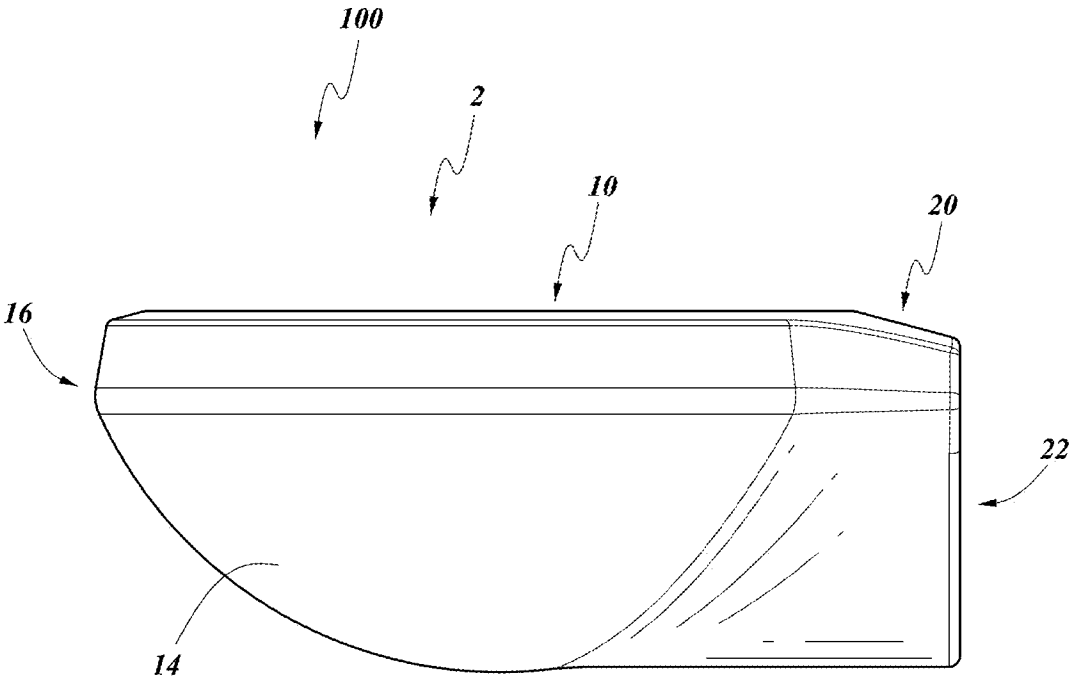
FIG. 6 is a left-side view of a handle in accordance with aspects of this disclosure.
Figure 7:
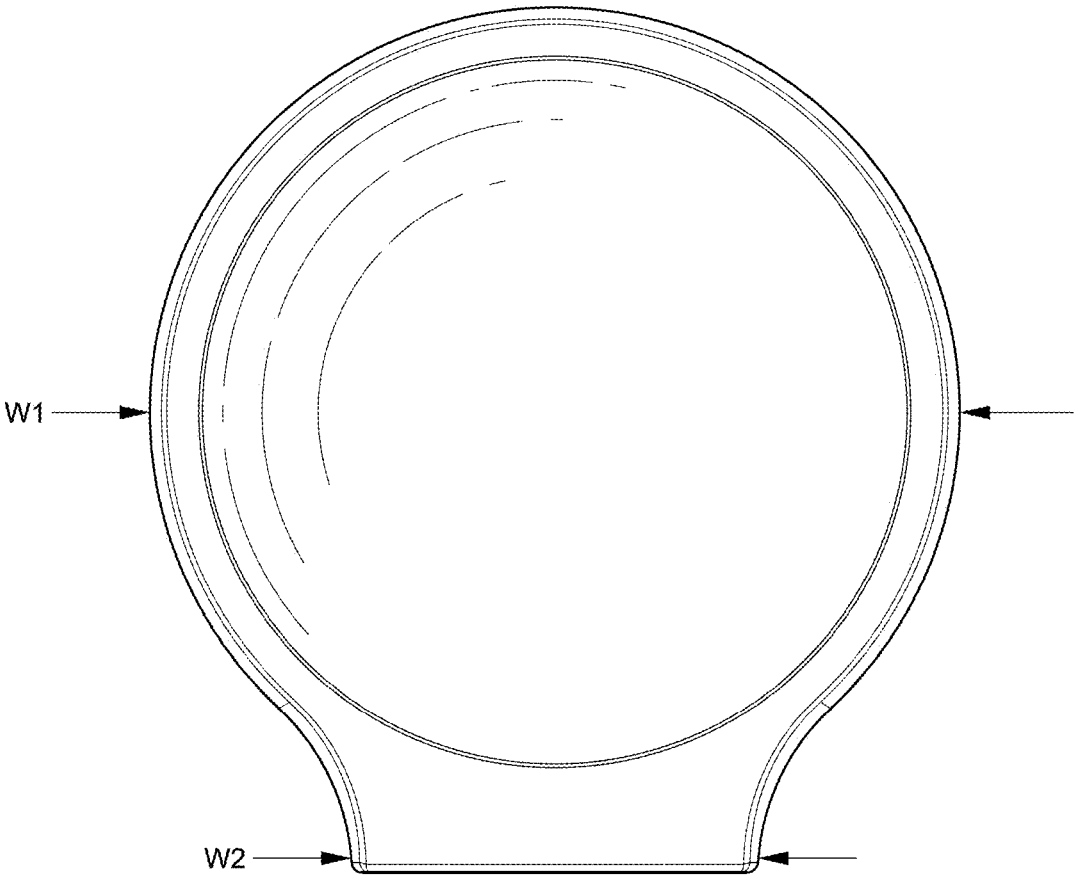
FIG. 7 is a top view of a handle in accordance with aspects of this disclosure.

The handle portion 10 can include a top surface 12 and a bottom surface 14. As best shown in FIGS. 1 and 7, at least a portion of the top surface 12 can be contoured. In some embodiments, said at least a portion of the top surface 12 can be contoured or curved. In some embodiments, said at least a portion of the top surface 12 can be concave. As best shown in FIGS. 4-6, at least a portion of the bottom surface 14 can be contoured or curved. In some embodiments, said at least a portion of the bottom surface 14 can be convex or domed. Alternatively, in some embodiments, said at least a portion of the bottom surface 14 can be concave. Advantageously, the top surface 12 and the bottom surface 14 provide an ergonomic handle 100 and allow a user to comfortably hold the handle 100 so the handle 100 does not slip or rotate in the user's hand or fingers, and that inhibits (e.g. prevents) fatigue of the user's hand during use of the substance applicator to apply the substance (e.g., nail polish, nail art, nail polish remover). As shown in FIG. 9E, the top surface 12 can optionally receive the user's thumb thereon and the bottom surface 14 can optionally receive one or more of the user's index, middle and ring fingers thereon, allowing the user to comfortably hold the handle 100 in their hand (e.g., with the index, middle and/or ring fingers flexed so that the fingers contact a greater surface area of the bottom surface 14). Additionally, the handle 100 can provide a user with a surface to hold that is larger than the substance applicator, increasing the user's comfort when applying a substance (e.g., nail polish, nail art) via the substance applicator.

Figure 8:
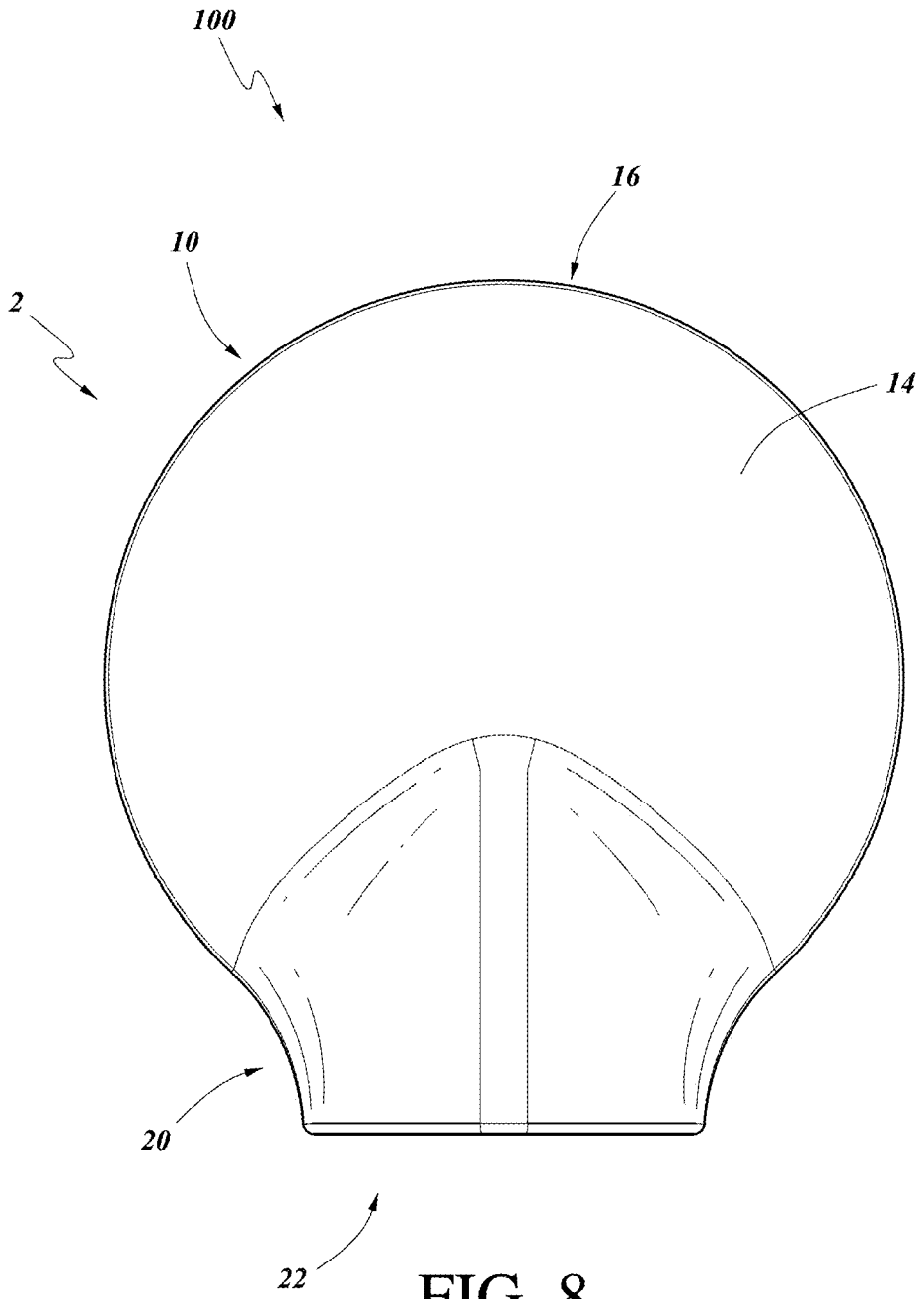
FIG. 8 is a bottom view of a handle in accordance with aspects of this disclosure.

As shown best in FIGS. 7 and 8, the top surface 12 and the bottom surface 14 can include a rounded outer profile such that the handle portion 10 includes a rounded outer profile. The rounded outer profile of the handle portion 10 can be shaped such that the handle portion 10 includes a width W1 (e.g., a maximum width) that is greater than a width W2 (e.g., a maximum width) of the neck portion 20. In some embodiments, the rounded outer profile can be circular. In some embodiments, the width W1 (e.g., maximum width) of the handle portion 10 can be about twice the width W2 (e.g., maximum width) of the neck portion 20.

Figure 3:
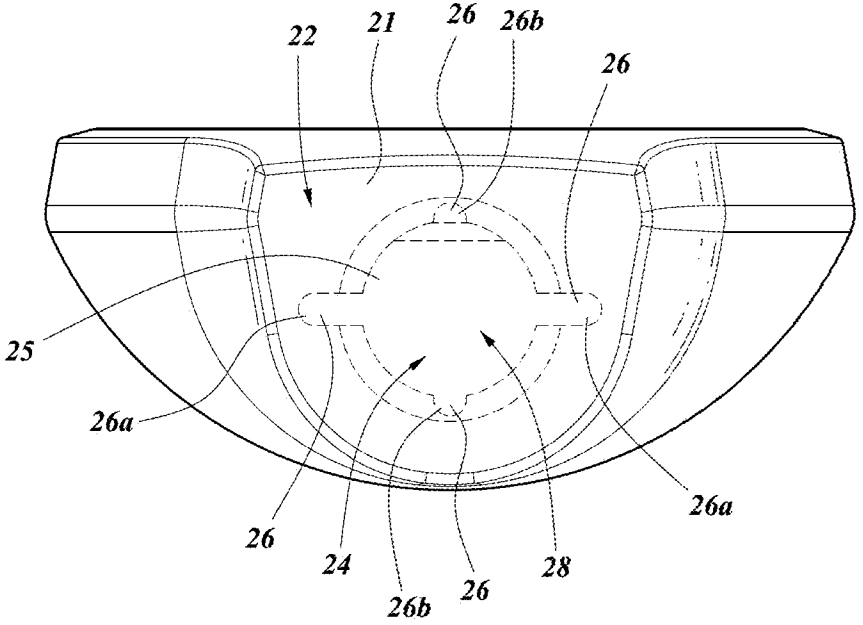
FIG. 3 is a front view of a handle in accordance with aspects of this disclosure.

As best shown in FIGS. 1 and 3, the neck portion 20 can include an end surface 21 at the distal end 22. In some embodiments, the end surface 21 can be perpendicular to at least a portion of the top surface 12 and/or the bottom surface 14. In some embodiments, the end surface 21 can be substantially flat. The end surface 21 can include a top edge 26 and a bottom edge 28. In some embodiments, one or both of the top edge 26 and the bottom edge 28 can be curved. In some embodiments, the top edge 26 can be substantially straight or uncurved. In some embodiments, the bottom edge 28 can include a same shape as a portion of a bottle.

The end surface 21 can include and opening 24. In some embodiments, the opening 24 can be in a center of the end surface 21. The opening 24 can include an outer edge 25 with a rounded profile, and in some embodiments, the outer edge 25 can include a circular profile. In some embodiments, the outer edge 25 can be substantially a same size and shape of a portion of the applicator such that when the portion of the applicator is inserted into the opening 24, an inner surface 23 of the opening 24 frictionally couples the applicator to the handle 100. The opening 24 can include one or more slots 26 around the outer edge 25. In some embodiments, the opening can include four slots 26 around the outer edge 25. In some embodiments, the opening can include two larger slots 26A (e.g., a first pair of slots 26A) that are larger than two smaller slots 26B (e.g., a second pair of slots 26B). In some embodiments, the four slots 26 can be distributed along the opening 24 such that the two larger slots 26A are opposite each other, and the two smaller slots 26B are opposite each other. In some embodiments, the two larger slots 26A can be on a left and right side of the opening 24, and the two smaller slots 26B can be on a top and a bottom of the opening 24. The one or more slots 26 can allow air to flow into or out of the opening 24 such that when the user inserts the portion of the applicator into the opening 24, a pressure in the opening 24 does not increase, and when the user removes the portion of the applicator from the opening 24, air in the opening 24 does not create a suction effect that inhibits (e.g., prevents) the removal of the applicator from the opening 24.

As shown best in FIG. 5, the end surface 21 can include a height H1 (e.g. maximum height) between the top edge 26 and the bottom edge 28, and the handle portion 10 can include a height H2 (e.g. maximum height) between the top surface 12 and the bottom surface 14. The height H1 can be smaller than the height H2 such that the top edge 26 below at least a portion of the top surface 12.

The opening 24 can extend from the distal end 22 through the neck portion 20 and into the handle portion 10. In some embodiments, the opening 24 can include a same rounded profile along a length of the opening 24. In some embodiments, a portion of the opening 24 in the handle portion 10 can include a width that is greater than a width of the opening 24 in the neck portion 20.

Figure 9A:
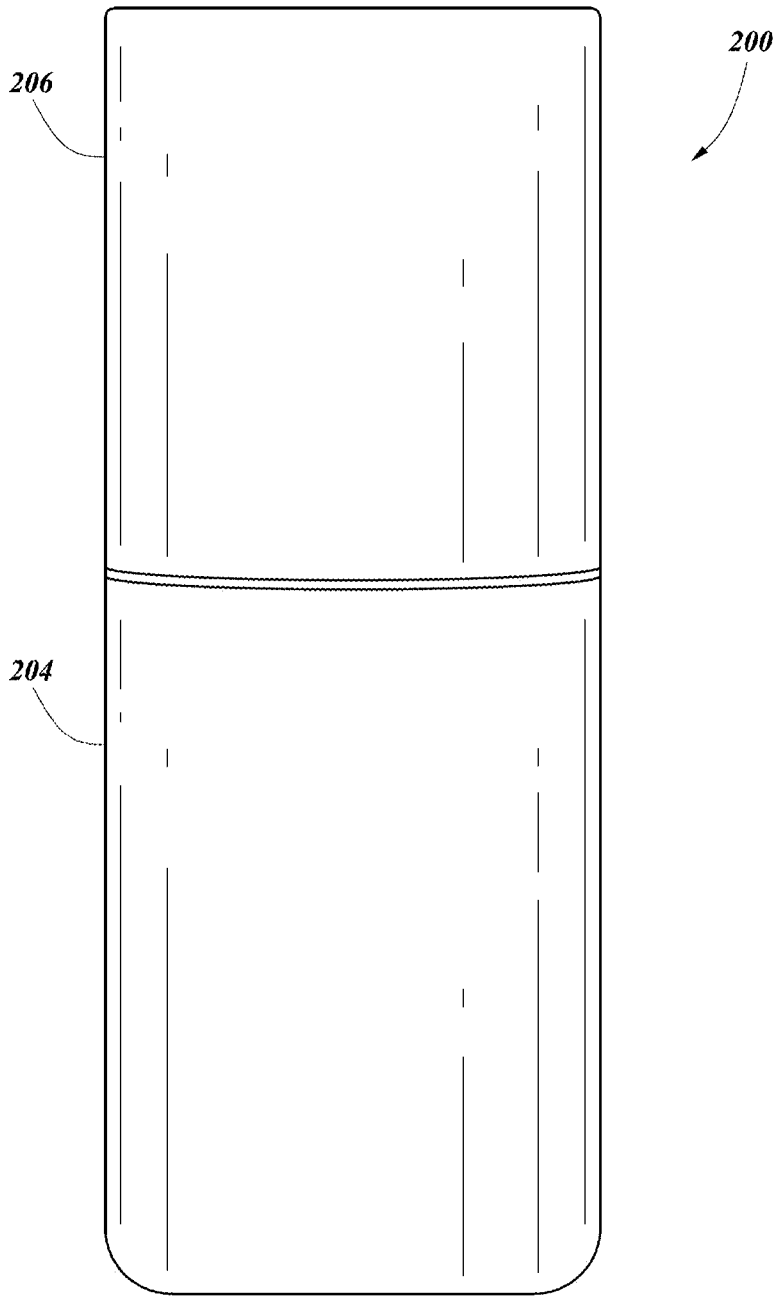
FIGS. 9A-9E are examples of a method of use of a handle in accordance with aspects of this disclosure.
Figure 9B:
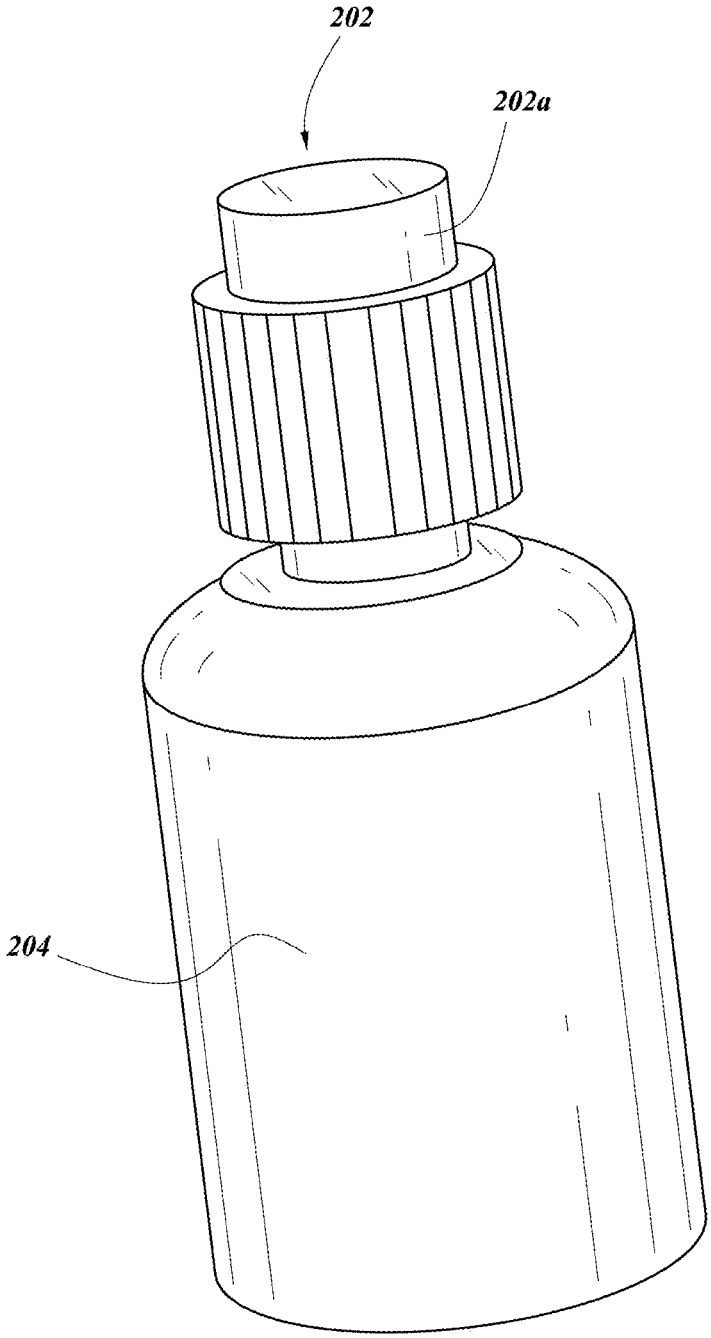
Figure 9C:
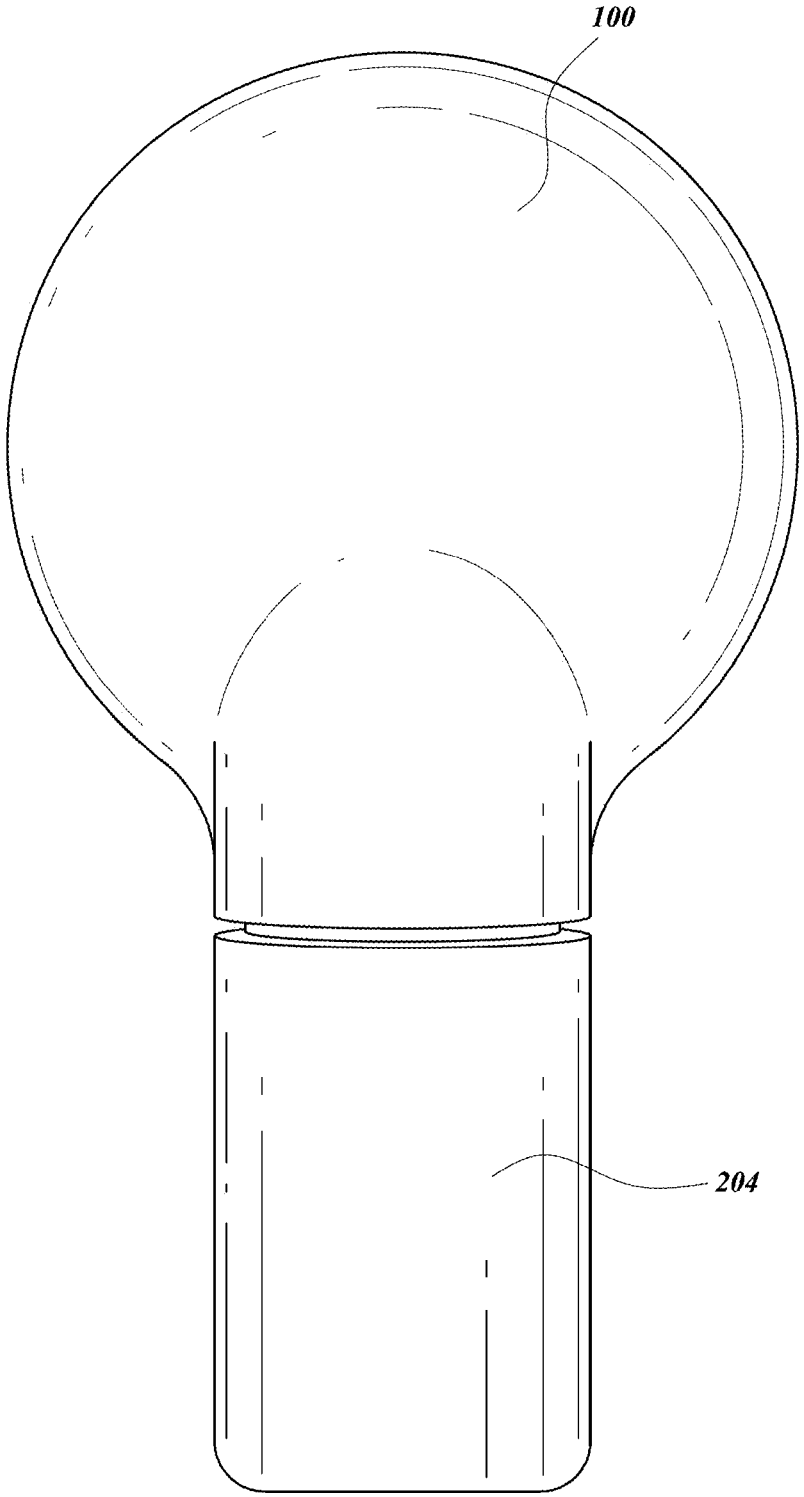
Figure 9D:
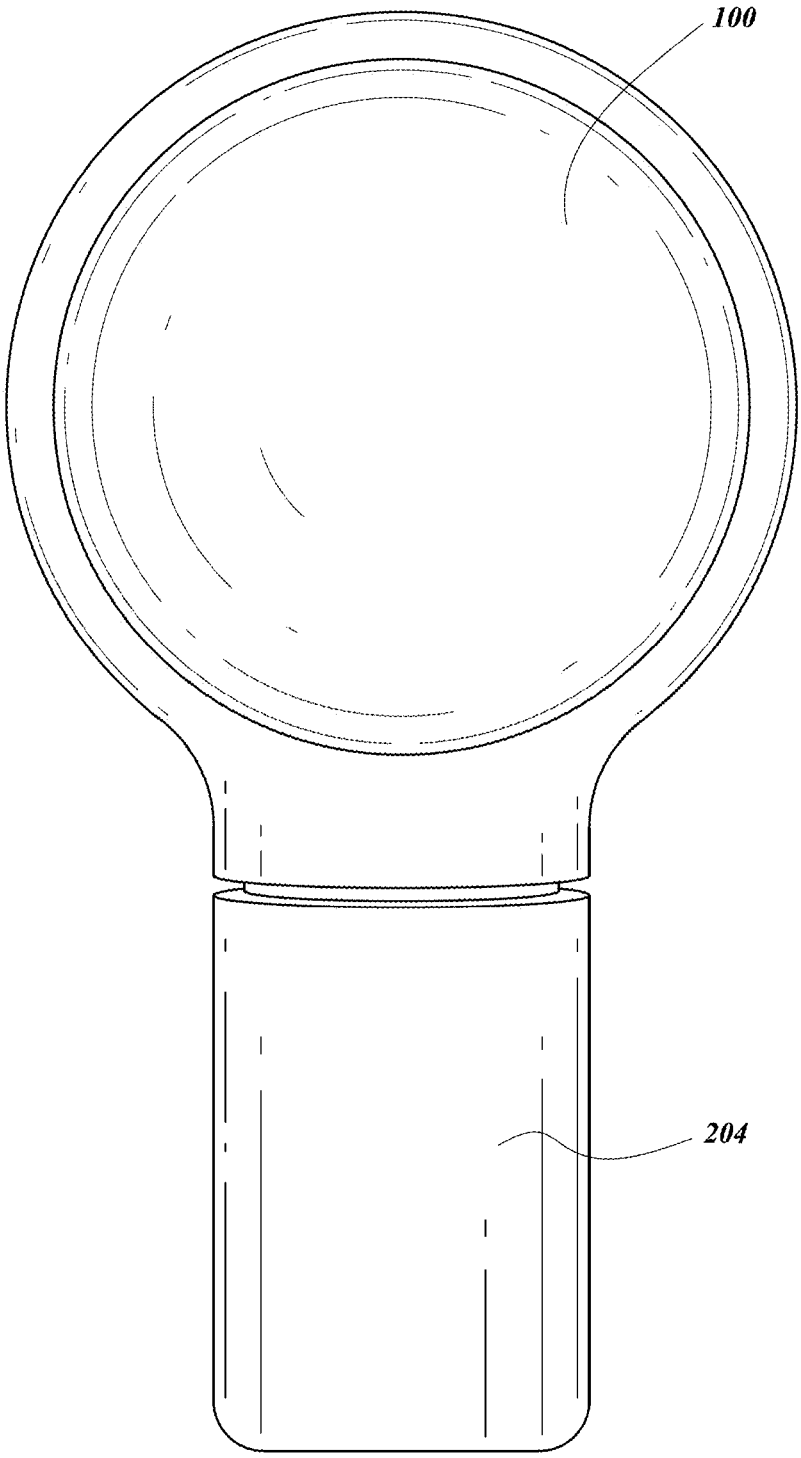
Figure 9E:
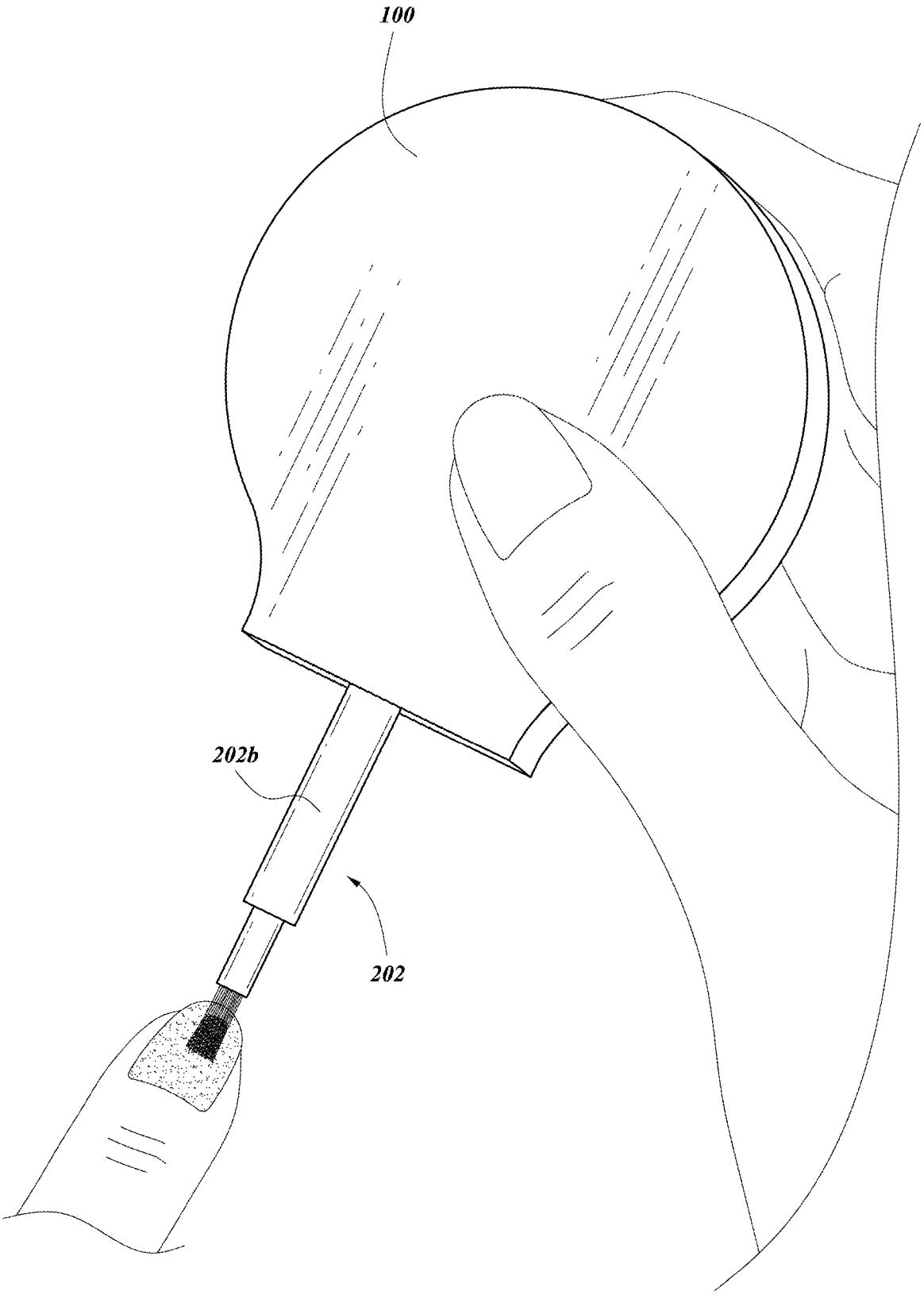
Figure 10:
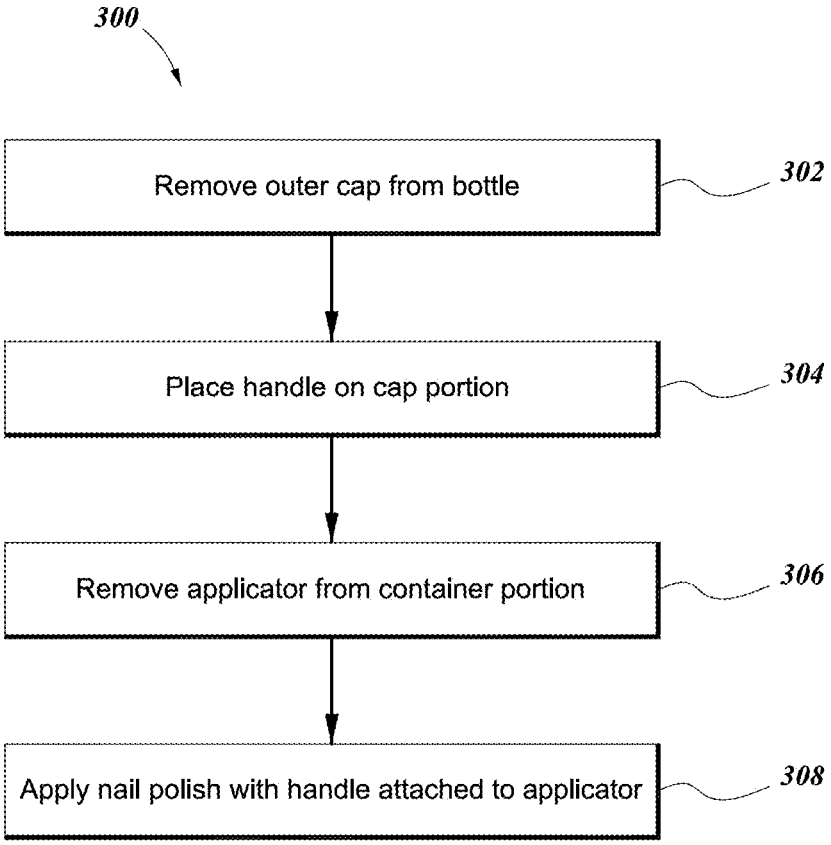
FIG. 10 is a schematic of a method of use of a handle in accordance with aspects of this disclosure.

FIGS. 9A-10 show an embodiment of the handle 100 and a method 300 of using the handle 100 with an applicator 202. The applicator can include a cap portion 202A with a rounded or circular shape and a brush portion 202B. The applicator 202 can be part of a bottle 200. The bottle 200 can include a container portion 204 and a removable outer cap 206. The container portion 204 can hold a substance (e.g., nail polish, nail art, nail polish remover). As shown best in FIGS. 9A-9B, the removable outer cap 206 can cover the cap portion 202A of the applicator 202 when the removable outer cap 206 is coupled to the container portion 204. The applicator 202 can removably couple to the container portion 204 such that the brush portion 202B is disposed inside the container portion 204 when the cap portion 202A is coupled to the container portion 204. In some embodiments, the cap portion 202A can be rotatably coupled to the container portion 204 such that a user can twist or rotate the cap portion 202A to separate cap portion 202A and the applicator 202 from the container portion 204.

As shown best in FIGS. 9C-9D, the cap portion 202A can be inserted into the opening 24 (shown in FIG. 1) of the handle 100 such that the handle 100 covers the cap portion 202A (e.g., by advancing the handle 100 relative to the cap portion 202A so that the cap portion 202A extends into the opening 24). In this way, as shown in FIG. 9E the user can hold onto the handle 100 when applying the substance with the brush portion 202B. Without the handle 100 the user can hold onto the cap portion 202A, however, due to the rounded or circular shape of the cap portion 202A, the applicator 202 can rotate in the user's hand or fingers making application of the substance difficult and also causing fatigue in the user's hand from prolonged use. Advantageously, as described above with reference to FIGS. 1-8, the handle 100 can be shape so the handle 100 does not rotate or slip in the user's hand or fingers reducing the difficulty of the application of the substance, and inhibiting (e.g., preventing) hand fatigue during use. Additionally, the width W1 of the handle portion 10 of the handle 100 can reduce an amount of force required for the user to twist or rotate the cap portion 202A and separate the cap portion 202A and the applicator 202 from the container portion 204.

As shown in FIG. 10 the user can use the handle 100 with the applicator 202 via method 300. At step 302, the user can remove the outer cap 206 from the bottle or container portion 204. The user can remove the outer cap 206 by rotating the outer cap 206 relative to the container portion 204 or by pulling the outer cap 206 off the container portion 204. The outer cap 206 can cover at least the cap portion 202A of the applicator 202 such that after the user removes the outer cap 206 at step 302 the applicator 202 can be coupled to the container portion 204 via the cap portion 202A.

At step 304, the user can place the handle 100 on the cap portion 202A or insert the cap portion 202A into the opening 24 (shown in FIG. 1) of the handle 100. In some embodiments, the user can remove or uncouple the applicator 202 from the container portion 204 by rotating the cap portion 202A relative to the container portion 204. The user can insert the brush portion 202B into the container portion 204 with the cap portion 202A uncoupled from the container portion 204. In this way, the user can place the handle 100 on the cap portion 202A or insert the cap portion 202A into the opening 24 of the handle 100 with the top surface 12 (shown in FIG. 1) lined up with or parallel to a flat or broad side of the brush portion 202B as shown in FIG. 9E. In some embodiments, the cap portion 202A can include a line or indicator to indicate to the user a location of the flat side of the brush portion 202B when the cap portion 202A is coupled to the container portion 204. In these embodiments, the user cannot remove or uncoupled the applicator from the container portion 204, and can place the handle 100 on the cap portion 202A or insert the cap portion 202A into the opening 24 of the handle 100 with the top surface 12 lined up with the line or indicator on the cap portion 202A.

At step 306, after the user places the handle 100 on the cap portion 202A or inserts the cap portion 202A into the opening 24 of the handle 100 at step 304, the user can remove the applicator 202 from the container portion 204 by rotating the handle 100 relative to the container portion 204 or by pulling the handle 100 and the applicator 100 off the container portion 204.

At step 308, after the user removes the applicator 202 from the container portion 204 at step 306, the user can apply a substance (e.g., nail polish, nail art, nail polish remover) to a nail (finger or toe nail) of a user's finger(s) and/or toes(s), as shown in FIG. 9E. The handle 100, as described above, can advantageously provide the user with a surface to hold that is larger than the cap portion 202A, increasing the user's comfort when applying the substance via the applicator 202.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 20% of, within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A handle for a nail polish applicator, the handle comprising:

a body comprising:

a top surface and a bottom surface, a portion of the bottom surface being curved, an end surface having a top edge adjacent the top surface, and an opening in the end surface configured to receive a nail polish applicator when the nail polish applicator is inserted into the opening, wherein two slots are defined in the end surface around an outer edge of the opening, a first slot of the two slots is positioned on a left side of the opening and a second slot of the two slots is positioned on a right side of the opening so the first slot and the second slot are arranged opposite each other and extend outward from the opening; and wherein the two slots extend longitudinally from the end surface along an inner surface of the opening into the body.

2. The handle of claim 1, wherein said at least a portion of the bottom surface is convex.

3. The handle of claim 1, wherein the end surface is perpendicular to the top surface.

4. The handle of claim 1, wherein the opening extends from the end surface into the body.

5. The handle of claim 1, wherein the opening comprises a rounded profile.

6. The handle of claim 1, wherein an inner surface of the opening is configured to frictionally couple the nail polish applicator to the handle.

7. The handle of claim 1, wherein a portion of the top surface is flat.

8. The handle of claim 1, where at least a portion of the top surface is concave.

9. The handle of claim 1, wherein a portion of the bottom surface extends linearly.

10. A handle for a nail polish applicator, the handle comprising:

a single-piece body comprising:

a top surface and a bottom surface, a portion of the bottom surface being convex, a portion of the bottom surface extending linearly, and a portion of the top surface being concave, an end surface having a top edge adjacent the top surface, and an opening in the end surface configured to receive a nail polish applicator when the nail polish applicator is inserted into the opening, wherein two slots are defined in the end surface around an outer edge of the opening, a first slot of the two slots is positioned on a left side of the opening and a second slot of the two slots is positioned on a right side of the opening so the first slot and the second slot are arranged opposite each other and extend outward from the opening; and wherein the two slots extend longitudinally from the end surface along an inner surface of the opening into the body.

11. The handle of claim 10, wherein the end surface is perpendicular to the top surface.

12. The handle of claim 10, wherein the opening extends from the end surface into the handle portion.

13. The handle of claim 10, wherein the opening comprises a rounded profile.

14. The handle of claim 10, wherein an inner surface of the opening is configured to frictionally couple the nail polish applicator to the handle.

15. The handle of claim 10, wherein at least a portion of the top surface is flat.

* * * * *